US005413274A

United States Patent [19]

Forbes, Jr.

[11] Patent Number: 5,413,274

[45] Date of Patent: May 9, 1995

[54] FRONT LOADED DISPLAY CARTON

[75] Inventor: Hampton E. Forbes, Jr., Edinburg, Va.

[73] Assignee: Westvaco Corporation, New York, N.Y.

[21] Appl. No.: 207,069

[22] Filed: Mar. 8, 1994

Related U.S. Application Data

[62] Division of Ser. No. 1,252, Jan. 6, 1993, Pat. No. 5,328,089.

[51] Int. Cl.[6] ..... B65D 25/04

[52] U.S. Cl. ..... 229/162; 229/120.26; 206/588

[58] Field of Search ..... 229/120.18, 120.24, 229/120.26, 120.29, 162, 112; 206/387, 588, 45, 45.14, 45.19, 45.31, 45.33

[56] References Cited

U.S. PATENT DOCUMENTS

| | | | |
|---|---|---|---|
| 2,807,404 | 9/1957 | Cote . | |
| 3,563,449 | 2/1971 | Forbes, Jr. | 229/120.18 X |
| 3,682,297 | 8/1972 | Austin et al. . | |
| 4,034,908 | 7/1977 | Forbes, Jr. et al. | 229/120.18 X |
| 4,113,086 | 9/1978 | Forbes, Jr. . | |
| 4,125,185 | 11/1978 | Bliss | 229/120.18 X |
| 4,134,495 | 1/1979 | Friedman | 229/120.21 X |
| 4,416,412 | 11/1983 | Wischusen, III | 206/588 X |
| 5,284,291 | 2/1994 | Sellors | 229/120.18 X |

*Primary Examiner*—Allan N. Shoap
*Assistant Examiner*—Christopher J. McDonald

[57] ABSTRACT

A front loaded display carton is formed from a one-piece, cut and scored blank of paperboard or the like that is preglued and shipped to the user in a collapsed condition. The carton when squared is of essentially rectangular configuration with a display opening in the front wall and a product containing pocket located interiorly of the carton beneath the display opening. The product containing pocket is formed by internal walls known generally as header panels and stop panels which are cut from the one-piece blank.

3 Claims, 2 Drawing Sheets

FRONT LOADED DISPLAY CARTON

This is a divisional of application Ser. No. 08/001,252 filed Jan. 6, 1993, now U.S. Pat. No. 5,328,089.

BACKGROUND OF INVENTION

The present invention relates generally to an improved display carton of the front loaded type with an interior product containing pocket located beneath a display opening in one wall of the carton. Cartons of this type are generally loaded through one end and are provided with dividers or interior panels for stopping, positioning, retaining and guiding the product as it is loaded in the carton. Examples of such cartons may be found for instance in U.S. Pat. No. 2,807,404 which includes a pair of false interior walls for supporting a product located therein; U.S. Pat. No. 3,682,297 which teaches a pilfer proof carton with interior partition walls; and, U.S. Pat. No. 4,113,086 which discloses stop panels and retaining panels. However, none of the cartons disclosed employ the unique one-piece construction and arrangement of interior panels disclosed herein.

SUMMARY OF INVENTION

The present invention relates generally to an improvement in the construction of display-type cartons and more particularly has for its principal purpose the provision of a front loaded carton with a unique interior formed by two glue applications and no more than two or three folding steps. The carton blank of the present invention is cut and scored from a single piece of foldable material (e.g. paper board or the like), and comprises an outer carton structure with a display opening and an integral interior product containing pocket portion for accepting, positioning and retaining a front loaded product. The carton is intended to package small items such as gifts, promotional sizes of larger products, cassette tapes and the like in such a manner that the products are isolated in a protected environment. This objective is achieved in the present invention by the strategic location of header panels and stop panels within the carton structure.

The present invention is carried out by including an extension panel on the blank structure for the carton which is cut and scored to form a first generally U-shaped section which is adhered to the interior of one wall of the carton and a second generally T-shaped section which is adhered to the interior of another wall of the carton. These sections are spaced from one another by strategically located header and stop panels for locating the product in the product containing pocket interiorly of the carton. Meanwhile one wall of the carton, preferably the top or front wall, is provided with a display opening located over the product pocket so that the carton can be loaded from the front. The loaded product is retained in its pocket by the header panels and stop panels, and by product retaining tabs located on the inner edges of the display opening.

DETAILED DESCRIPTION

Figure 1:
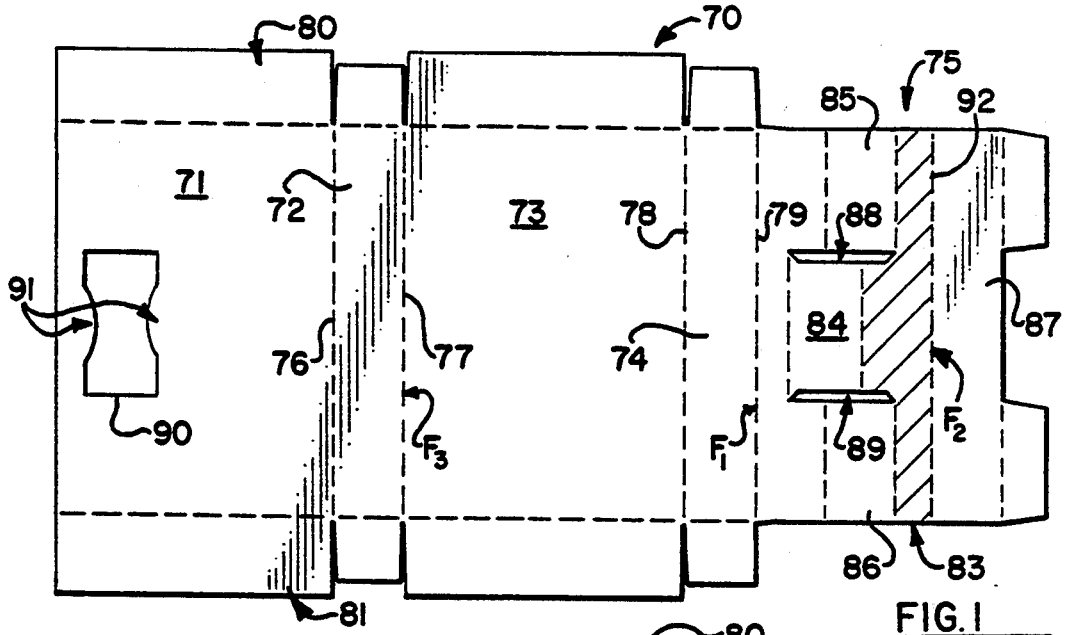
FIG. 1 is a plan view of a blank for making a preferred embodiment of the carton of the present invention.

A preferred embodiment of the present invention is shown in detail in FIGS. 1–6. For this embodiment, the blank 70 comprises in sequence a front panel 71, first side wall panel 72, rear or bottom panel 73, second side wall panel 74 and an extension panel 75 connected together by parallel, spaced apart scored lines 76–79. Panels 71–74 in conjunction with the end flaps 80, 81 form the outer structure of the carton of this embodiment while the extension panel 75 is designed to provide a product retaining pocket. Extension panel 75 is divided by cut and scored lines to yield a generally U-shaped section 82 (shown in FIG. 14) and a generally T-shaped section 83 shown in FIG. 13. These sections are separated from one another by spacer panels 84, 85, 86 and 87 formed by separate parallel score lines and cut lines, or in the illustrated embodiment, narrow cut-outs 88 and 89. Cut-outs 88, 89 are shown only to provide a slightly staggered relationship between the spacer panels to accommodate a specific product.

Figure 2:
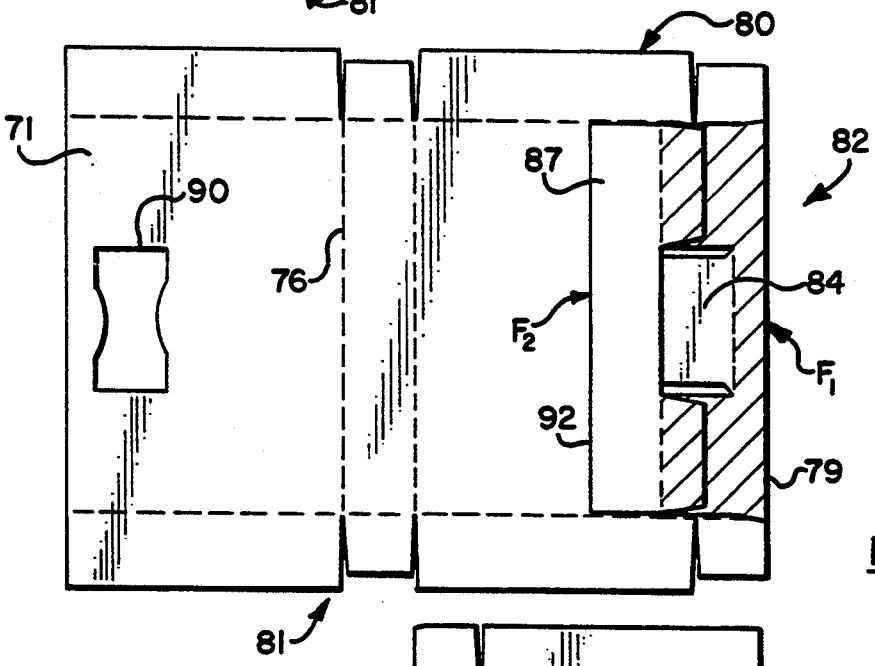
FIG. 2 illustrates the blank of FIG. 1 after the first and second folding steps.
Figure 3:
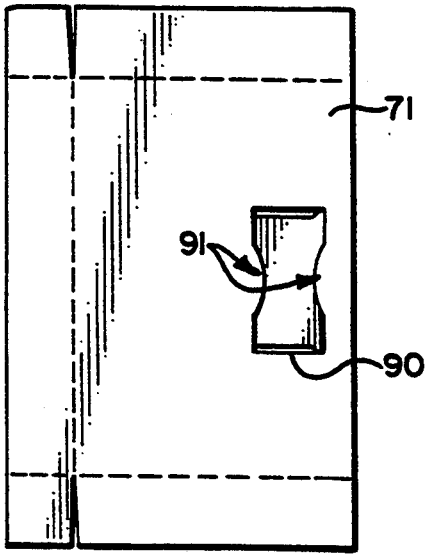
FIG. 3 shows the blank completely folded to form the carton in collapsed condition.

When the carton blank 70 of FIG. 1 is prepared for folding into its carton configuration, as shown in FIGS. 2 and 3, adhesive is applied to the T-shaped section 83 of extension panel 75 prior to the first folding step $F_1$ along scored line 79. At that point, the T-shaped section 83 is adhered to the inside of rear wall 73. Next, the second folding step $F_2$ is carried out along scored line 92, as shown in FIG. 2, where adhesive is applied to the U-shaped section 82 of extension panel 75. At this point, the blank is folded along score line 77 to carryout folding step $F_3$ which adheres the U-shaped section 82 to the inside of front wall 71 and fully forms the carton in its collapsed condition as shown in FIG. 3.

Figure 4:
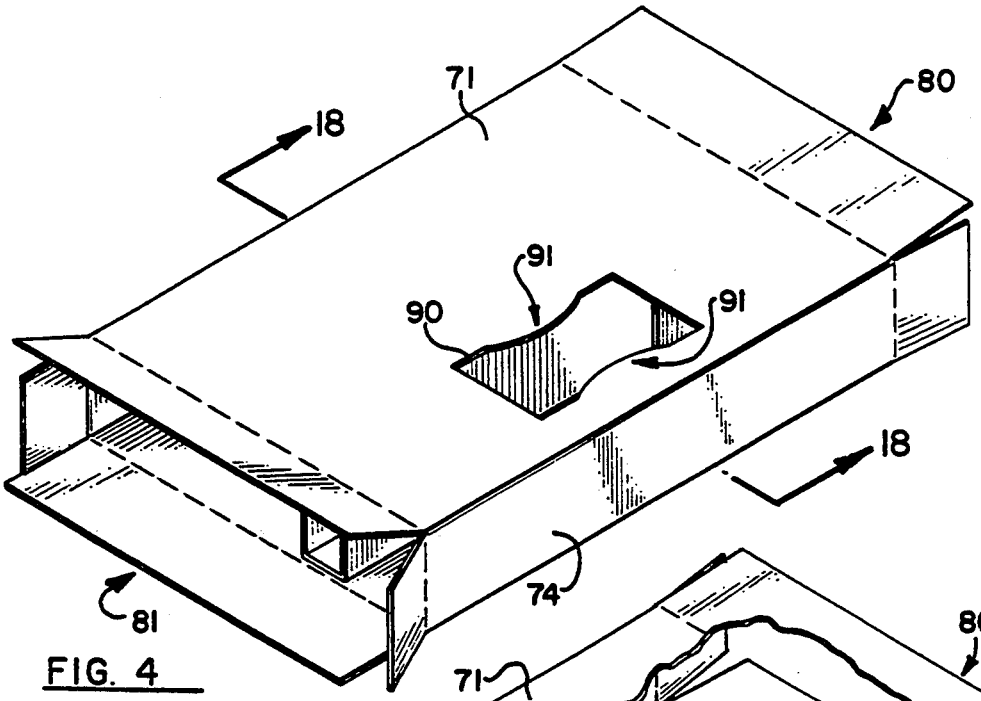
FIG. 4 is a perspective view of the carton of FIG. 3 in its set-up condition.
Figure 5:
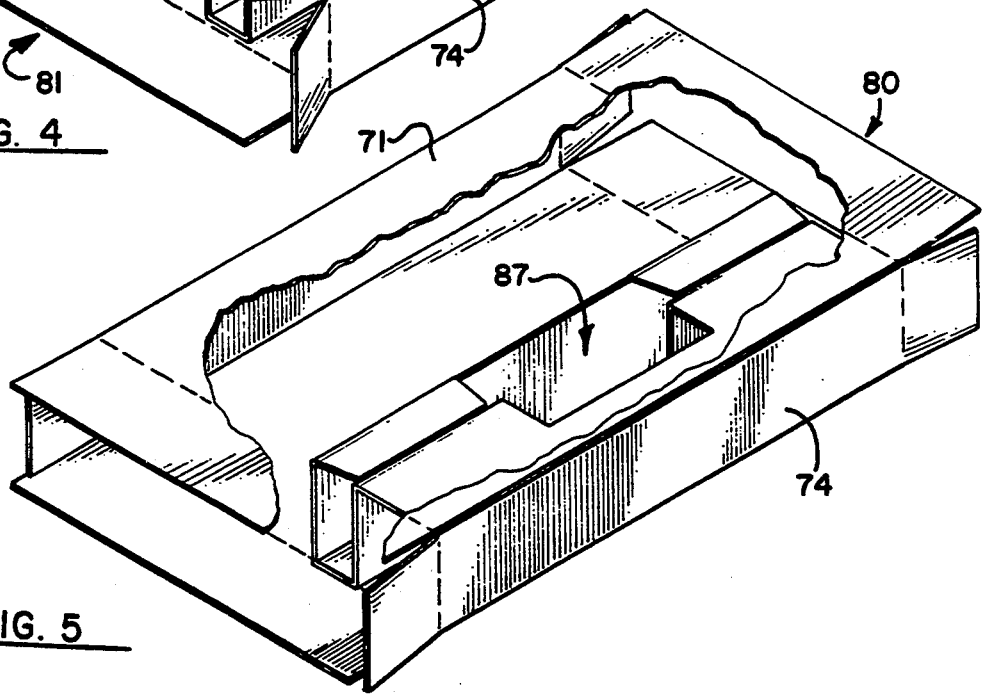
FIG. 5 is a perspective view of the carton of FIG. 4 with its top panel partially cut away to show the product-containing interior compartment; and, FIG. 6 is a cross sectional view taken along the lines 6—6 of FIG. 5.
Figure 6:
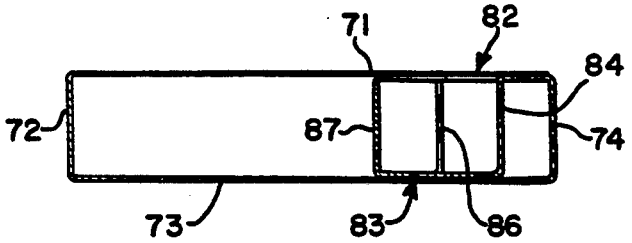

When the carton is squared as shown in FIG. 4, the end closure flaps 80, 81 may be closed to complete the carton and prepare it for loading. FIGS. 5 and 6 illustrate details of the inner product pocket of the carton. In particular, the pocket is formed by header panels 84 and 87 and the product stop panels 85, 86. The generally U-shaped section 82 of the extension panel 75 is adhered to the inside of the front panel 71 and the generally T-shaped section 83 is adhered to the inside of bottom panel 73 It will be understood that the product pocket and display cut-out 90 may be readily relocated within the carton as desired.

It may thus be seen that the present invention provides an improved collapsible display carton with a display opening located over a product containing pocket which is easy to manufacture, assemble and erect. The carton of the present invention is economical of material used, economical of labor to produce, and fully protects and isolates the packaged product. The specification and the accompanying drawing discloses a preferred embodiment using a cut and scored extension panel with generally U-shaped and T-shaped glued sections which produce the novel product containing pocket. However, even though this preferred embodiment has been described in detail, it will be apparent to those skilled in the art that changes and variations may be made in the construction of the carton within the scope of the invention as defined in the appended claims.

What is claimed is:

1. A collapsible display carton prepared from a folded blank of paperboard comprising front and rear panels joined to opposing side wall panels along scored fold lines, end closure flaps foldably attached to the ends of said front, rear and side wall panels, a display opening cut from said front panel and an extension panel foldably attached to one of said side wall panels, said extension panel being cut and scored to provide a U-shaped section the entirety of which is adhered to the interior of said front wall, a T-shaped section the entirety of which is adhered to the interior of said rear wall, a pair of stop panels located adjacent to the vertical leg of said T-shaped section, a header panel beneath the vertical leg of said T-shaped section, and a second header panel located adjacent to the horizontal leg of said T-shaped section, said stop panels and header panels being adapted to form a product pocket beneath the display opening.

2. A front loaded carton of generally rectangular configuration, formed from a single blank of paperboard comprising, spaced outer front and rear walls separated from one another by a pair of outer side walls, end closure flaps for each end of the carton, a combination display/product loading opening formed in said front wall and an inner product receiving pocket located interiorly of said carton beneath said display/-product loading opening, said product receiving pocket being formed by a pair of spaced apart header panels (84, 87) located on either side of said product receiving pocket and a pair of stop panels (85, 86) located in the same plane at each end of said product receiving pocket.

3. The carton of claim 2 wherein the inner product receiving pocket is formed by an extension panel foldably attached to a side wall of said carton which is cut and scored to provide U-shaped (82) and T-shaped (83) sections which are adhered to the inner surfaces of said front and rear panels, said header panels (84, 87) being located between said U-shaped and T-shaped sections.

* * * * *